US011132962B2

(12) United States Patent
Zhu et al.

(10) Patent No.: US 11,132,962 B2
(45) Date of Patent: Sep. 28, 2021

(54) DATA TRANSMISSION METHOD, TIMING CONTROLLER, SOURCE DRIVER, AND DATA TRANSMISSION SYSTEM

(71) Applicants: Beijing BOE Display Technology Co., Ltd., Beijing (CN); BOE Technology Group Co., Ltd., Beijing (CN)

(72) Inventors: Hao Zhu, Beijing (CN); Xin Wang, Beijing (CN); Xibin Shao, Beijing (CN); Ming Chen, Beijing (CN); Jieqiong Wang, Beijing (CN); Xin Duan, Beijing (CN); Chengqi Zhou, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/620,351

(22) PCT Filed: Jun. 4, 2018

(86) PCT No.: PCT/CN2018/089756
§ 371 (c)(1),
(2) Date: Dec. 6, 2019

(87) PCT Pub. No.: WO2018/223920
PCT Pub. Date: Dec. 13, 2018

(65) Prior Publication Data

US 2020/0202802 A1 Jun. 25, 2020

(30) Foreign Application Priority Data

Jun. 9, 2017 (CN) ..... 201710433782.1

(51) Int. Cl.
*G09G 3/36* (2006.01)

(52) U.S. Cl.
CPC ..... *G09G 3/36* (2013.01); *G09G 2330/021* (2013.01); *G09G 2370/08* (2013.01)

(58) Field of Classification Search
CPC ..... G09G 5/006; G09G 3/2096; G09G 5/003; G09G 2330/021; H04N 5/63
See application file for complete search history.

(56) References Cited

U.S. PATENT DOCUMENTS

2012/0105414 A1 5/2012 Yu et al.
2013/0229404 A1 9/2013 Ishida et al.
(Continued)

FOREIGN PATENT DOCUMENTS

CN 102456329 A 5/2012
CN 103155022 A 6/2013
(Continued)

OTHER PUBLICATIONS

International Search Report and Written Opinion of the International Searching Authority with English language translation, PCT/CN2018/089756, dated Aug. 20, 2018, 15 pages.
(Continued)

*Primary Examiner* — Kevin M Nguyen
(74) *Attorney, Agent, or Firm* — Myers Bigel, P.A.

(57) ABSTRACT

The present disclosure describes a data transmission method, a timing controller, a source driver, and a data transmission system. The method includes: when the timing controller transmits data to the source driver at a speed n times a preset speed, the timing controller suspends transmission of valid data with the source driver after completing transmission of a first data packet; and the transmission of valid data with the source driver is resumed at a transmitting time of a second data packet; the first data packet and the second data packet each includes valid data of a row of sub-pixels, or each includes valid data of a frame. The
(Continued)

present disclosure completes the transmission of the first data packet in advance by increasing the transmission speed, then suspends the data transmission, and resumes the data transmission at the transmitting time of the second data packet, thereby reducing the power consumption.

11 Claims, 7 Drawing Sheets

(56) References Cited

U.S. PATENT DOCUMENTS

2015/0243254 A1 8/2015 Won-Tae
2015/0349920 A1* 12/2015 Stolitzka ..... H03M 13/2906 714/776
2016/0044238 A1* 2/2016 Takada ..... H04N 5/232411 348/222.1
2016/0372077 A1 12/2016 Ja-Hun et al.
2016/0379538 A1 12/2016 Long
2017/0295343 A1* 10/2017 Konishi ..... G09G 3/3666

FOREIGN PATENT DOCUMENTS

CN 104538000 A 4/2015
CN 104867433 A 8/2015
CN 104916250 A 9/2015

OTHER PUBLICATIONS

Chinese Office Action corresponding to CN 20170433782.1; dated Jun. 1, 2021 (48 pages, including English machine translation).
Wuping, Liu , "Color TV repair from entry to master", National Defense Industry Press, Edition 1, Beijing, China, Apr. 30, 2009, 218-221.

* cited by examiner

DATA TRANSMISSION METHOD, TIMING CONTROLLER, SOURCE DRIVER, AND DATA TRANSMISSION SYSTEM

CROSS REFERENCE TO RELATED APPLICATIONS

The present application is a 35 U.S.C. 371 national stage application of PCT international Application No. PCT/CN2018/089756 filed on Jun. 4, 2018, which claims the benefit of Chinese Patent Application No. 201710433782.1, filed on Jun. 9, 2017, the entire disclosures of which are incorporated herein by reference.

TECHNICAL FIELD

The present disclosure relates to the field of display technology, and in particular to a data transmission method, a timing controller, a source driver, and a data transmission system.

BACKGROUND

A driving part of a liquid crystal display panel usually includes a timing controller and a source driver. The main function of the timing controller is to process image data and generate valid data corresponding to the image data. The valid data is transmitted to the source driver, which converts the received valid data into a data voltage to be written to a corresponding pixel on the liquid crystal display panel.

When the liquid crystal display panel is operating, the timing controller transmits data to the source driver at a preset speed (which is determined by the size and the refresh rate of the liquid crystal display panel). Generally, when the timing controller transmits data, the valid data of each row of sub-pixels is sequentially transmitted to the source driver, and the source driver can control each row of sub-pixels to display according to the valid data of each row of sub-pixels. After transmitting the valid data of one row of sub-pixels, the timing controller will transmit the valid data of the next row of sub-pixels and after transmitting the valid data of the current frame (the valid data of one frame includes the valid data of the sub-pixels of all the rows in this frame), the timing controller will transmit the valid data of the next frame to the source driver at the beginning of the next frame.

However, when the liquid crystal display panel is operating, the power consumption for data transmission between the timing controller and the source driver is usually large.

SUMMARY

Therefore, it is desirable to provide a data transmission method, a timing controller, a source driver, and a data transmission system.

According to a first aspect of the present disclosure, there is provided a data transmission method applied to a timing controller, the timing controller transmitting data to a source driver at a speed n times a preset speed, the preset speed being determined according to a size and a refresh rate of a display panel, n being greater than or equal to 1, and the method comprises:

suspending transmission of valid data with the source driver after completing transmission of a first data packet;

resuming transmission of valid data with the source driver at a transmitting time of a second data packet;

wherein the second data packet is a next data packet transmitted after the first data packet, and the first data packet and the second data packet each comprises valid data of a row of sub-pixels, or each comprises valid data for a frame.

Optionally, the method further comprises:

transmitting, in a process of transmitting the first data packet, low power control signaling to the source driver, the low power control signaling being configured to notify the source driver to suspend transmission of valid data with the timing controller after reception of the first data packet is completed.

Optionally, before the suspending transmission of valid data with the source driver, the method further comprises:

transmitting invalid data to the source driver after completing transmission of the first data packet, to wait for the source driver to suspend receiving valid data transmitted by the timing controller.

Optionally, the invalid data comprises 64 invalid data packets, and each of the invalid data packets comprises 10 bits.

Optionally, the suspending transmission of valid data with the source driver comprises:

disconnecting a communication link for transmitting data with the source driver.

Optionally, the suspending transmission of valid data with the source driver comprises:

maintaining a communication link for transmitting data with the source driver and suspending the transmission of valid data with the source driver.

Optionally, the method further comprises:

transmitting a resume transmission signal to the source driver before a transmitting time of the second data packet, the resume transmission signal being configured to notify the source driver to resume the transmission of valid data with the timing controller.

Optionally, the resume transmission signal comprises clock patterns and link stable patterns in accordance with an order of transmission, and wherein the clock patterns are configured to synchronize clock signals of the source driver and the timing controller, and the link stable patterns are configured to wait for the source driver and the timing controller to resume transmission of valid data.

Optionally, a number of the clock patterns is greater than or equal to 48, and a number of the link stable patterns is greater than or equal to 5, and the duration of the link stable patterns is at least 1 microsecond.

Optionally, the first data packet comprises a control packet, the control packet is provided with a power saving control bit, and the transmitting the low power control signaling to the source driver comprises:

setting the power saving control bit to indicate the low power control signaling;

transmitting the first data packet comprising the control packet to the source driver.

According to a second aspect of the present disclosure, there is provided a data transmission method applied to a source driver, the source driver receiving data from a timing controller at a speed n times a preset speed, the preset speed being determined according to a size and a refresh rate of a display panel, n being greater than or equal to 1, and the method comprises:

suspending transmission of valid data with the timing controller after completing reception of a first data packet;

resuming transmission of valid data with the timing controller at a receiving time of a second data packet;

wherein the second data packet is a next data packet transmitted after the first data packet, and the first data packet and the second data packet each comprises valid data of a row of sub-pixels, or each comprises valid data for a frame.

Optionally, the method further comprises:

receiving, in a process of receiving the first data packet, low power control signaling transmitted by the timing controller, and suspending the transmission of valid data with the timing controller according to the low power control signaling after reception of the first data packet is completed.

Optionally, the suspending transmission of valid data with the timing controller comprises:

disconnecting a communication link for transmitting data with the timing controller.

Optionally, the suspending transmission of valid data with the timing controller comprises:

maintaining a communication link for transmitting data with the timing controller and suspending transmission of valid data with the timing controller.

Optionally, the method further comprises:

receiving a resume transmission signal transmitted by the timing controller before the receiving time of the second data packet, and resuming transmission of valid data with the timing controller according to the resume transmission signal.

Optionally, the resume transmission signal comprises clock patterns and link stable patterns in accordance with an order of transmission, and wherein the clock patterns are configured to synchronize clock signals of the source driver and the timing controller, and the link stable patterns are configured to wait for the source driver and the timing controller to resume transmission of valid data.

Optionally, a number of the clock patterns is greater than or equal to 48, and a number of the link stable patterns is greater than or equal to 5, and the duration of the link stable patterns is at least 1 microsecond.

Optionally, the first data packet comprises a control packet, the control packet comprises a power saving control bit, and the suspending transmission of valid data with the timing controller comprises:

determining whether the power saving control bit indicates the low power control signaling;

in response to the power saving control bit indicating the low power control signaling, suspending the transmission of valid data with the timing controller after reception of the first data packet is completed.

According to a third aspect of the present disclosure, there is provided a timing controller configured to transmit data to a source driver at a speed n times a preset speed, the preset speed being determined according to a size and a refresh rate of a display panel, n being greater than or equal to 1, wherein the timing controller comprises:

a first suspending device configured to suspend transmission of valid data between the timing controller and the source driver after completing transmission of a first data packet;

a first resuming device configured to resume transmission of valid data between the timing controller and the source driver at a transmitting time of a second data packet;

wherein the second data packet is a next data packet transmitted after the first data packet, and the first data packet and the second data packet each comprises valid data of a row of sub-pixels, or each comprises valid data for a frame.

Optionally, the timing controller further comprises:

a power saving controller configured to set a power saving control bit of a control packet of the first data packet to indicate low power control signaling, wherein the low power control signaling is configured to notify the source driver to suspend transmission of valid data with the timing controller after reception of the first data packet is completed.

Optionally, the timing controller further comprises:

an invalid data transmitter configured to, after completing transmission of the first data packet, transmit invalid data to the source driver to wait for the source driver to suspend receiving valid data transmitted by the timing controller.

Optionally, the invalid data comprises 64 invalid data packets, and each of the invalid data packets comprises 10 bits.

Optionally, the first suspending device is further configured to:

disconnect a communication link of the timing controller for transmitting data with the source driver.

Optionally, the first suspending device is further configured to:

maintain a communication link of the timing controller for transmitting data with the source driver and suspend transmission of valid data between the timing controller and the source driver.

Optionally, the timing controller further comprises:

a resume signal transmitter configured to transmit a resume transmission signal to the source driver before the transmitting time of the second data packet, the resume transmission signal being configured to notify the source driver to resume the transmission of valid data with the timing controller.

Optionally, the resume transmission signal comprises clock patterns and link stable patterns in accordance with an order of transmission, and wherein the clock patterns are configured to synchronize clock signals of the source driver and the timing controller, and the link stable patterns are configured to wait for the source driver and the timing controller to resume transmission of valid data.

Optionally, a number of the clock patterns is greater than or equal to 48, and a number of the link stable patterns is greater than or equal to 5, and the duration of the link stable patterns is at least 1 microsecond.

Optionally, the first data packet comprises a control packet, the control packet comprises a power saving control bit, and the power saving controller is further configured to:

set the power saving control bit to indicate the low power control signaling;

transmit the first data packet comprising the control packet to the source driver.

According to a fourth aspect of the present disclosure, there is provided a source driver configured to receive data from a timing controller at a speed n times a preset speed, the preset speed being determined according to a size and a refresh rate of a display panel, n being greater than or equal to 1, and the source driver comprises:

a second suspending device configured to suspend transmission of valid data between the source driver and the timing controller after completing reception of a first data packet;

a second resuming device configured to resume transmission of valid data between the source driver and the timing controller at a receiving time of a second data packet;

wherein the second data packet is a next data packet transmitted after the first data packet, and the first data packet and the second data packet each comprises valid data of a row of sub-pixels, or each comprises valid data for a frame.

Optionally, the source driver further comprises:

a power saving signal receiver configured to receive, in a process of receiving the first data packet, low power control signaling transmitted by the timing controller, and suspend the transmission of valid data between the source driver and the timing controller according to the low power control signaling after reception of the first data packet is completed.

Optionally, the second suspending device is further configured to:

disconnect a communication link of the source driver for transmitting data with the timing controller.

Optionally, the second suspending device is further configured to:

maintain a communication link of the source driver for transmitting data with the timing controller and suspend transmission of valid data between the timing controller and the source driver.

Optionally, the source driver further comprises:

a resume signal receiver configured to receive a resume transmission signal transmitted by the timing controller before a receiving time of the second data packet, and resume the transmission of valid data between the source driver and the timing controller according to the resume transmission signal.

Optionally, the resume transmission signal comprises clock patterns and link stable patterns in accordance with an order of transmission, and wherein the clock patterns are configured to synchronize clock signals of the source driver and the timing controller, and the link stable patterns are configured to wait for the source driver and the timing controller to resume transmission of valid data.

Optionally, a number of the clock patterns is greater than or equal to 48, and wherein a number of the link stable patterns is greater than or equal to 5, and the duration of the link stable patterns is at least 1 microsecond.

Optionally, the first data packet comprises a control packet, the control packet comprises a power saving control bit, and the second suspending device is further configured to:

determine whether the power saving control bit indicates the low power control signaling;

in response to the power saving control bit indicating the low power control signaling, suspend the transmission of valid data between the source driver and the timing controller after reception of the first data packet is completed.

According to a fifth aspect of the present disclosure, a data transmission system is provided, comprising:

any of the timing controllers according to the third aspect of the present disclosure;

any of the source drivers according to the fourth aspect of the present disclosure.

According to a sixth aspect of the present disclosure, there is provided a computer readable non-transitory storage medium storing instructions that, when executed on a computer, cause the computer to perform any of the data transmission methods according to the first or second aspect of the present disclosure.

BRIEF DESCRIPTION OF THE DRAWINGS

For a better understanding of the objects, features, and advantages of the present disclosure, the embodiments of the present disclosure are described herein by way of illustration rather than limitation with reference to the accompanying drawings.

DETAILED DESCRIPTION OF THE DISCLOSURE

In order to make the objects, technical solutions and advantages of the present application more clear, embodiments of the present disclosure will be further described in detail below with reference to the accompanying drawings.

Figure 1:
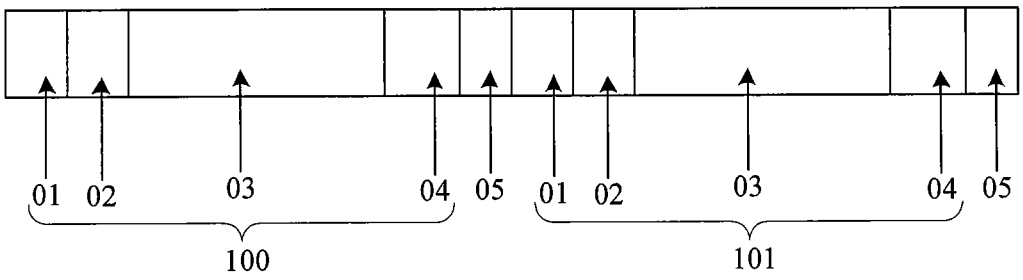
FIG. 1 is a schematic diagram of valid data transmitted by a timing controller to a source driver.

FIG. 1 is a schematic diagram of valid data transmitted by a timing controller to a source driver. As shown in FIGS. 1, 100 and 101 are valid data of two rows of sub-pixels, respectively. 01 is a start tag indicating the start of valid data. 02 is a control packet, including control signaling. 03 is a luminance data of a sub-pixel. 04 is an end tag indicating the end of valid data. 05 is idle data, and the idle data may include a clock pattern, and the clock pattern may be used for signal synchronization between a timing controller and a source driver.

Figure 2:
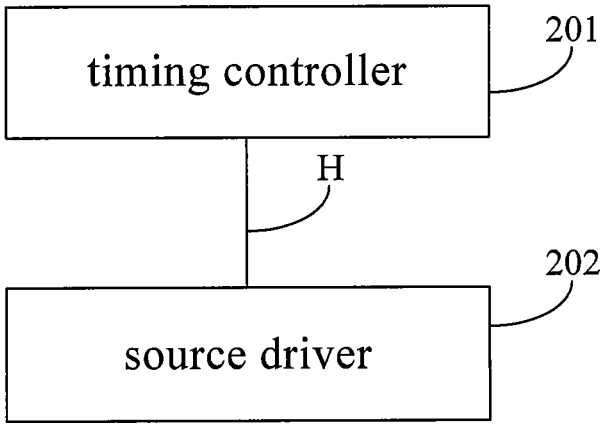
FIG. 2 is a schematic diagram of an application environment of a data transmission method according to an embodiment of the present disclosure.

FIG. 2 is a schematic diagram of an application environment of a data transmission method according to an embodiment of the present disclosure. The data transmission method is applied to a display device including a timing controller 201 and a source driver 202. A signal line H of the timing controller 201 is connected to the source driver 202.

The interface between the timing controller 201 and the source driver 202 can be a point to point interface. The P2P interface can refer to related technologies, and details are not described herein again.

Figure 3:
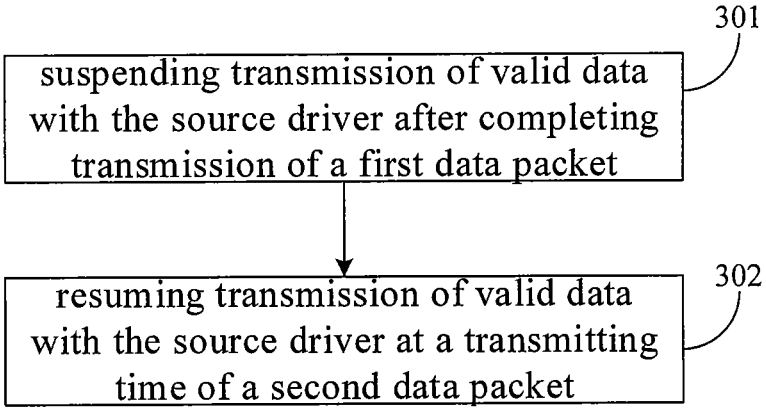
FIG. 3 is a flowchart of a data transmission method according to an embodiment of the present disclosure.

FIG. 3 is a flowchart of a data transmission method according to an embodiment of the present disclosure. This embodiment is described by taking the method applied to the timing controller as an example. The timing controller transmits data to the source driver at a speed n times a preset speed. The preset speed is determined according to a size and a refresh rate of a display panel, and n is greater than or equal to 1. The data transmission method may include the following steps:

step 301: suspending transmission of valid data with the source driver after completing transmission of a first data packet;

step 302: resuming transmission of valid data with the source driver at a transmitting time of a second data packet;

wherein the second data packet is a next data packet transmitted after the first data packet, and the first data packet and the second data packet each includes valid data of a row of sub-pixels, or each includes valid data for a frame.

In summary, in the data transmission method provided by the embodiments of the present disclosure, the transmission of the first data packet is completed in advance by increasing the transmission speed, then the data transmission is suspended, and the data transmission is resumed at the transmitting time of the second data packet. Thus, the problem that power consumption for data transmission between the timing controller and the source driver is large in related art is solved. The timing controller and the source driver can suspend data transmission to reduce power consumption.

Figure 4A:
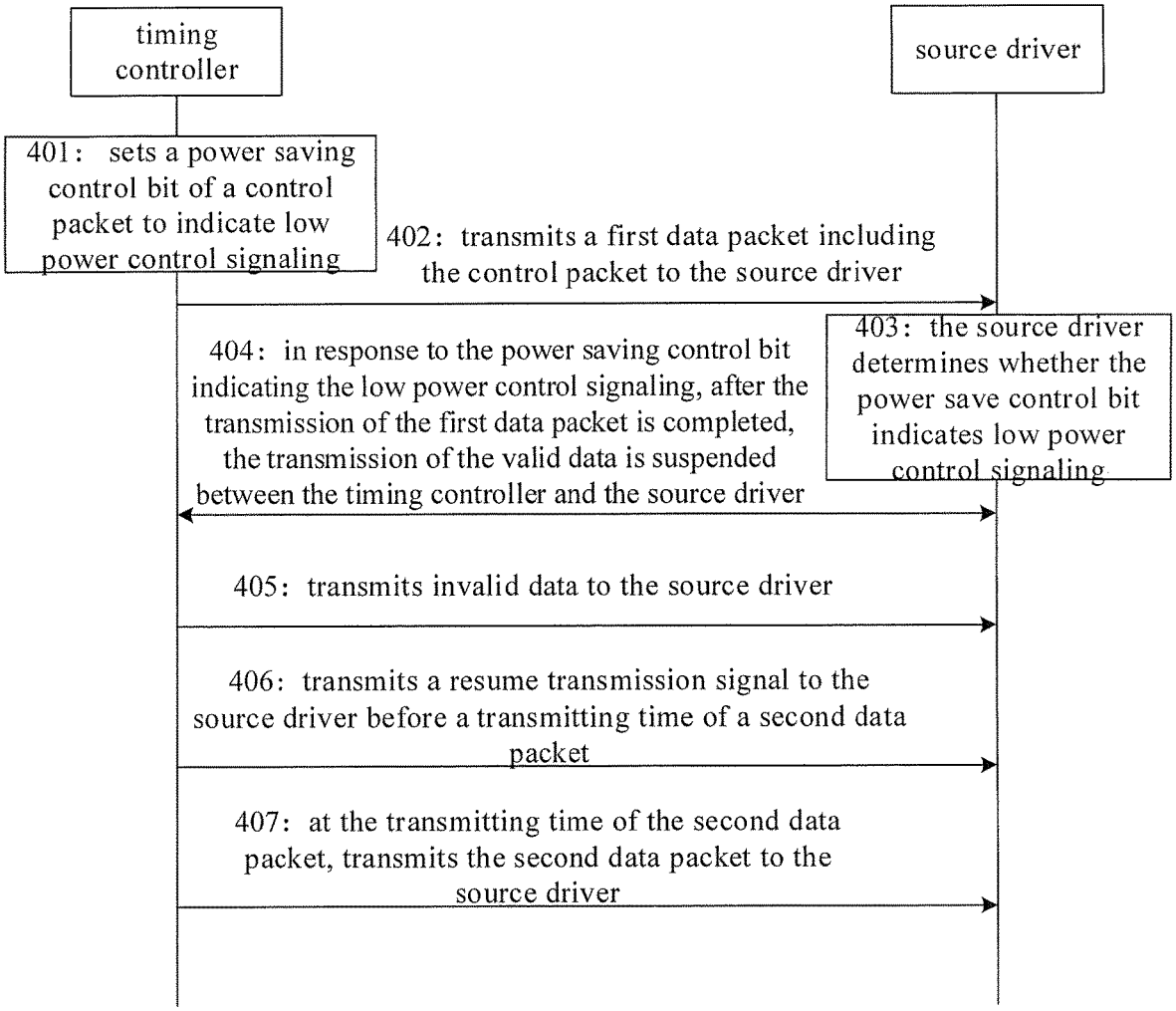
FIG. 4*a* is a flowchart of another data transmission method according to an embodiment of the present disclosure.

FIG. 4*a* is a flowchart of another data transmission method according to an embodiment of the present disclosure. This embodiment is described by taking the method applied to the timing controller as an example. The timing controller transmits data to the source driver at a speed n times a preset speed. The preset speed is determined according to a size and a refresh rate of a display panel, and n is greater than or equal to 1. The data transmission method may include the following steps 401-407.

At step 401, the timing controller sets a power saving control bit of a control packet to indicate low power control signaling.

When using the data transmission method provided by an embodiment of the present disclosure, a timing controller (TCON) may set a power saving control bit of a control packet to indicate low power control signaling, the low power control signaling is configured to notify the source driver (SD) to suspend the transmission of valid data with the timing controller after completing reception of a first data packet. Suspending the transmission of valid data between the timing controller and the source driver can be referred to as the timing controller and the source driver entering a power saving mode of operation.

The data packets (such as a first data packet and a second data packet) involved in the embodiments of the present disclosure may include valid data of a row of sub-pixels, or may include valid data of a frame. That is, in the data transmission method according to the embodiments of the present disclosure, the power saving control may be performed during the transmission of the valid data of each row of sub-pixels, or the power saving control may be performed during the transmission of the valid data of each frame.

Figure 4B:
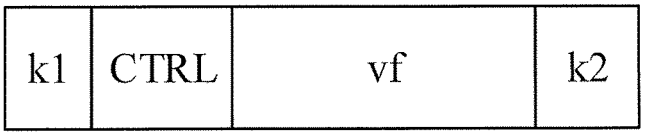
FIG. 4*b* is a schematic structural diagram of valid data in the embodiment shown in FIG. 4*a;*

The structure of the valid data can be as shown in FIG. 4*b*, where k1 indicates the start of the valid data and CTRL is a control packet. CTRL can comprise CTRL_L and CTRL_F, CTRL_L is a control packet for a row of sub-pixels, and CTRL_F is a control packet for a frame of data (CTRL_F appears at the beginning of each frame of data). The power saving control bit in CTRL_L may be LKSLEEPH, and the power saving control bit in CTRL_F may be LKSLEEPV, and the power saving control bit may be set to indicate low power control signaling. Vf is the luminance data of a sub-pixel, and k2 indicates the end of the valid data.

The timing controller can set the power saving control bit of any one of the data packets transmitted to the source driver to indicate low power control signaling, that is, the display panel can enter the power saving mode of operation at any time.

At step 402, the timing controller transmits a first data packet including the control packet to the source driver.

When the timing controller transmits the first data packet, the transmission speed is n times of the preset speed, and the value of n can be determined by factors such as the transmission coding mode between the timing controller and the source driver. In this way, data is transmitted at a higher speed, thereby improving the transmission efficiency of valid data, so that valid data transmission can be completed in a shorter time.

It should be noted that, in the embodiments of the present disclosure, the speed of various data transmitted by the timing controller to the source driver may be n times of the preset speed, and the preset speed may be determined according to the size and the refresh rate of the display panel. The higher the refresh rate, the larger the preset speed. The larger the size of the display panel, the larger the preset speed.

At step 403, the source driver determines whether the power save control bit indicates low power control signaling. After receiving the control packet, the source driver can determine whether the power saving control bit indicates low power control signaling.

At step 404, in response to the power saving control bit indicating the low power control signaling, after the transmission of the first data packet is completed, the transmission of the valid data is suspended between the timing controller and the source driver.

There are two ways to suspend valid data transmission between the timing controller and the source driver.

The first way: the timing controller disconnects the communication link for transmitting data with the source driver.

After the communication link between the timing controller and the source driver is disconnected, no data is transmitted between them. This method significantly reduces the energy consumption and avoids misjudgment of signal interference.

The second way: the timing controller maintains a communication link for transmitting data with the source driver but suspends transmission of valid data with the source driver.

It should be noted that when the timing controller maintains the communication link with the source driver, a signal such as a clock signal for maintaining the communication link is still transmitted between them. Thus, the reduction in energy consumption in this way is lower than that in the first way, but the time taken to resume the transmission of valid data between the timing controller and the source driver is shorter.

In addition, when the power saving control bit does not indicate low power control signaling, the timing controller and the source driver may not suspend transmission of valid data.

At step 405, the timing controller transmits invalid data to the source driver.

After transmission of valid data is completed, the timing controller also transmits invalid data to the source driver to wait for the source driver to suspend receiving valid data transmitted by the timing controller. This is because a suspension in the transmission of valid data between the timing controller and the source driver requires a preparation time. If the transmission of valid data is stopped suddenly, the normal operation of the source driver may be affected, it is necessary to buffer by transmitting invalid data. The invalid data may include 64 invalid data packets, each invalid data packet including 10 bits.

At step 406, the timing controller transmits a resume transmission signal to the source driver before a transmitting time of a second data packet.

The resume transmission signal is configured to notify the source driver to resume the transmission of valid data with the timing controller. The resumed transmission signals may include clock patterns and link stable patterns in accordance with an order of transmission. The clock patterns are configured to synchronize the clock signals of the source driver and the timing controller. The link stable patterns are configured to wait for the source driver and the timing controller to resume the transmission of valid data.

In an embodiment, a number of clock patterns is greater than or equal to 48 and a number of link stable patterns is greater than or equal to 5. Generally, the transmitting time of the five link stable patterns may be at least about 1 microsecond.

After receiving the resume transmission signal, the source driver resumes the transmission of valid data with the timing controller. If the communication link between the source driver and the timing controller is disconnected in step 404, the source driver will resume the communication link with the timing controller and the transmission of valid data after receiving the resume transmission signal.

It should be noted that the resume transmission signal is transmitted at time "b" before the transmitting time "a" of the second data packet, and the end time of transmitting the resume transmission signal is the transmitting time of the second data packet.

It should also be noted that the transmitting time of the second data packet is a preset transmitting time. When the timing controller transmits data to the source driver, the valid data of each frame or the valid data of each row of sub-pixels has a preset transmitting time. The transmitting time of the valid data of each frame is determined by the refresh rate of the display panel. Exemplarily, if the refresh rate of the display panel is 60 Hz, from the 0th second, every 1/60 second is the preset transmitting time of the valid data of a frame. The transmitting time of the valid data of each row of sub-pixels is determined by the refresh rate of the display panel and a number of rows of sub-pixels. Exemplarily, if the refresh rate of the display panel is 60 Hz, and there are 10 rows of sub-pixels in the display panel, from the 0th second, every 1/600 second is the preset transmitting time of the valid data of a row of sub-pixels.

At step 407, at the transmitting time of the second data packet, the timing controller transmits the second data packet to the source driver.

At the transmitting time of the second data packet, the transmission of valid data has been resumed between the timing controller and the source driver, and the timing controller can normally transmit the second data packet to the source driver.

Figure 4C:
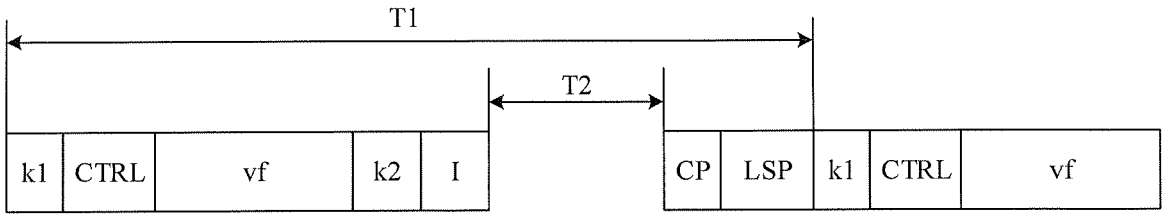
FIG. 4*c* is a schematic structural diagram of data transmitted by the timing controller to the source driver in the embodiment shown in FIG. 4*a;*

FIG. 4*c* is a schematic structural diagram of data transmitted by the timing controller to the source driver in the embodiment shown in FIG. 4*a*. As shown in FIG. 4*c*, the data transmitted by the timing controller to the source driver is the start tag k1, the control packet CTRL, the luminance data of of a sub-pixel, the end tag k2, the invalid data I, the clock pattern CP, and the link stable pattern LSP in accordance with the order of transmission. The time between the invalid data I and the clock pattern CP is the power saving operating time during which no valid data is transmitted. The time period T1 is the time conventionally required for transmitting the first data packet when data is transmitted between the timing controller and the source driver at a preset speed. The time period T2 is the time during which no valid data is transmitted between the timing controller and the source driver in the embodiment of the present disclosure, the timing controller and the source driver consume less power in the time period T2.

As an example, in a case where the first data packet includes valid data of the x-th frame, and the second data packet includes valid data of the (x+1)-th frame, the timing controller may enter the power saving mode of operation after transmitting the valid data of the x-th frame, and exit the power saving mode of operation before transmitting the valid data of the (x+1)-th frame, and then transmit the valid data of the (x+1)-th frame at the transmitting time of the valid data of the (x+1)-th frame. The timing controller may transmit the valid data of the (x+1)-th frame by referring to the case where the valid data of the x-th frame is transmitted, and details are not described herein again.

In summary, in the data transmission method provided by the embodiments of the present disclosure, the transmission of the first data packet is completed in advance by increasing the transmission speed, then the data transmission is suspended, and the data transmission is resumed at the transmitting time of the second data packet. Thus, the problem that power consumption for data transmission between the timing controller and the source driver is large in related art is solved. The timing controller and the source driver can suspend data transmission to reduce power consumption.

Figure 5A:
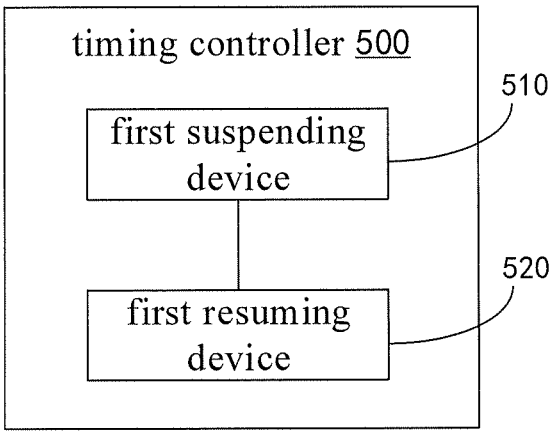
FIG. 5*a* is a block diagram of a timing controller according to an embodiment of the present disclosure.

FIG. 5*a* is a block diagram of a timing controller 500 according to an embodiment of the present disclosure. The timing controller transmits data to the source driver at a speed n times a preset speed. The preset speed is determined according to a size and a refresh rate of a display panel, and n is greater than or equal to 1. The timing controller 500 may include:

a first suspending device 510 configured to suspend transmission of valid data between the timing controller and the source driver after completing transmission of a first data packet;

a first resuming device 520 configured to resume transmission of valid data between the timing controller and the source driver at a transmitting time of a second data packet;

wherein the second data packet is a next data packet transmitted after the first data packet, and the first data packet and the second data packet each comprises valid data of a row of sub-pixels, or each comprises valid data for a frame.

Figure 5B:
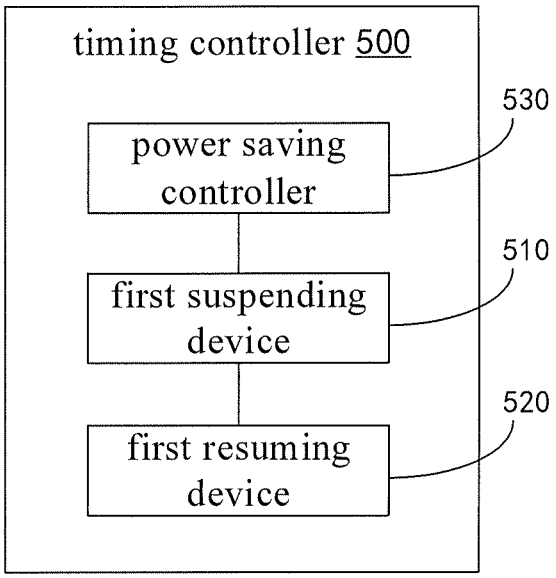
FIG. 5*b* is a block diagram of another timing controller according to an embodiment of the present disclosure.

In an embodiment, as shown in FIG. 5*b*, the timing controller 500 may further include:

a power saving controller 530 configured to set a power saving control bit of a control packet of the first data packet to indicate low power control signaling, wherein the low power control signaling is configured to notify the source driver to suspend transmission of valid data with the timing controller after reception of the first data packet is completed.

Figure 5C:
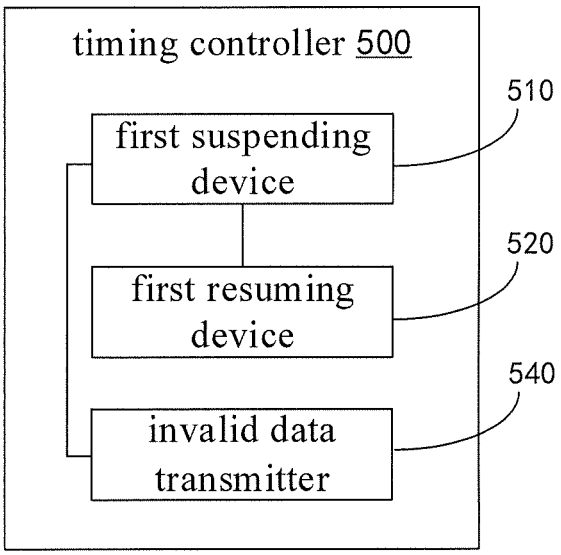
FIG. 5*c* is a block diagram of another timing controller according to an embodiment of the present disclosure.

In an embodiment, as shown in FIG. 5*c*, the timing controller 500 may further include:

an invalid data transmitter 540 configured to, after completing transmission of the first data packet, transmit invalid data to the source driver to wait for the source driver to suspend receiving valid data transmitted by the timing controller.

The invalid data may include 64 invalid data packets, and each invalid data packet may include 10 bits.

As an example, to suspend transmission of valid data between the timing controller and the source driver, the first suspending device 510 may be configured to disconnect a communication link for transmitting data between the timing controller and the source driver.

As an example, to suspend transmission of valid data between the timing controller and the source driver, the first suspending device 510 can be configured to maintain a communication link for transmitting data between the timing controller and the source driver but suspend transmission of valid data between the timing controller and the source driver.

Figure 5D:
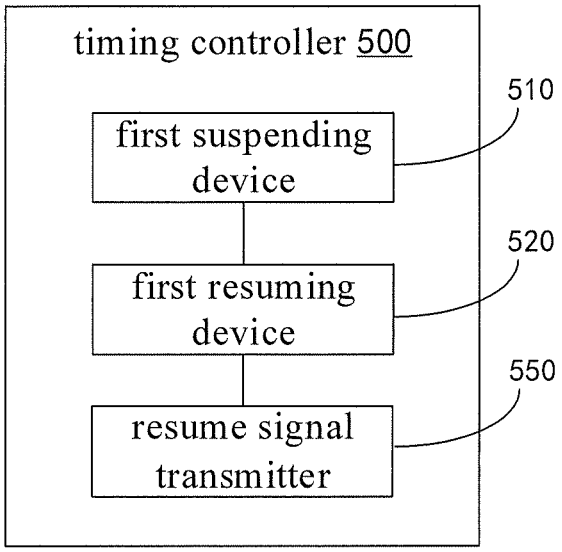
FIG. 5*d* is a block diagram of another timing controller according to an embodiment of the present disclosure.

In an embodiment, as shown in FIG. 5*d*, the timing controller 500 may further include:

a resume signal transmitter 550 configured to transmit a resume transmission signal to the source driver before the transmitting time of the second data packet, the resume transmission signal is configured to notify the source driver to resume the transmission of valid data with the timing controller.

Optionally, the resume transmission signal includes clock patterns and link stable patterns in accordance with an order of transmission. The clock patterns are configured to synchronize clock signals of the source driver and the timing controller, and the link stable patterns are configured to wait for the source driver and the timing controller to resume transmission of valid data.

Optionally, a number of the clock patterns is greater than or equal to 48. A number of the link stable patterns is greater than or equal to 5, and the duration of the link stable patterns is at least 1 microsecond.

Optionally, the first data packet includes a control packet, and the control packet includes a power saving control bit. The power saving control bit may be set to indicate low power control signaling or not to indicate low power control signaling.

In summary, in the timing controller provided by the embodiments of the present disclosure, the transmission of the first data packet is completed in advance by increasing the transmission speed, then the data transmission is suspended, and the data transmission is resumed at the transmitting time of the second data packet. Thus, the problem that power consumption for data transmission between the timing controller and the source driver is large in related art is solved. The timing controller and the source driver can suspend data transmission to reduce power consumption.

Figure 6A:
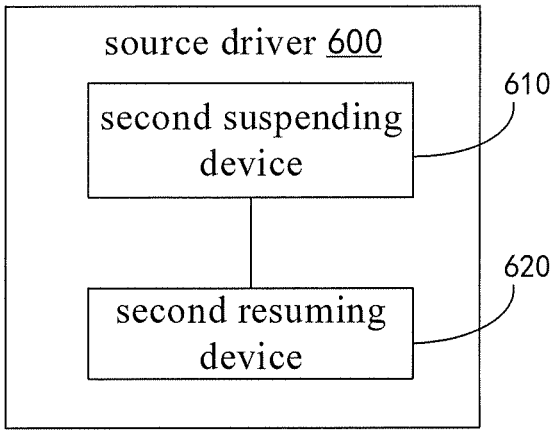
FIG. 6*a* is a block diagram of a source driver according to an embodiment of the present disclosure.

FIG. 6*a* is a block diagram of a source driver 600 according to an embodiment of the present disclosure. The speed at which the source driver receives data from the timing controller is n times a preset speed, and the preset speed is determined according to a size and a refresh rate of a display panel, and n is greater than or equal to 1. The source driver 600 may include:

a second suspending device 610 configured to suspend transmission of valid data between the source driver and the timing controller after completing reception of a first data packet;

a second resuming device 620 configured to resume transmission of valid data between the source driver and the timing controller at a receiving time of a second data packet;

wherein the second data packet is a next data packet transmitted after the first data packet, and the first data packet and the second data packet each comprises valid data of a row of sub-pixels, or each comprises valid data for a frame.

Figure 6B:
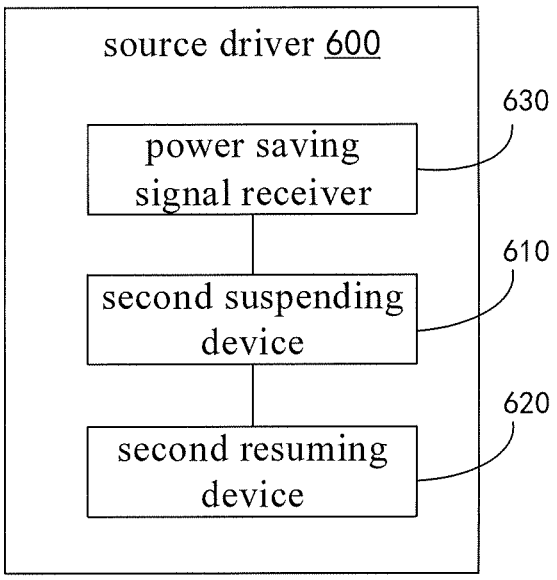
FIG. 6*b* is a block diagram of another source driver according to an embodiment of the present disclosure.

Optionally, as shown in FIG. 6*b*, the source driver 600 may further include:

a power saving signal receiver 630 configured to receive, in a process of receiving the first data packet, low power control signaling transmitted by the timing controller. The second suspending device suspends the transmission of valid data between the source driver and the timing controller according to the low power control signaling after reception of the first data packet is completed.

Optionally, to suspend transmission of valid data between the source driver and the timing controller, the second suspending device 610 may be configured to disconnect a communication link for transmitting data between the timing controller and the source driver.

Optionally, to suspend transmission of valid data between the source driver and the timing controller, the second suspending device 610 may be configured to maintain a communication link for transmitting data between the timing controller and the source driver and to suspend transmission of valid data between the source driver and the timing controller.

Figure 6C:
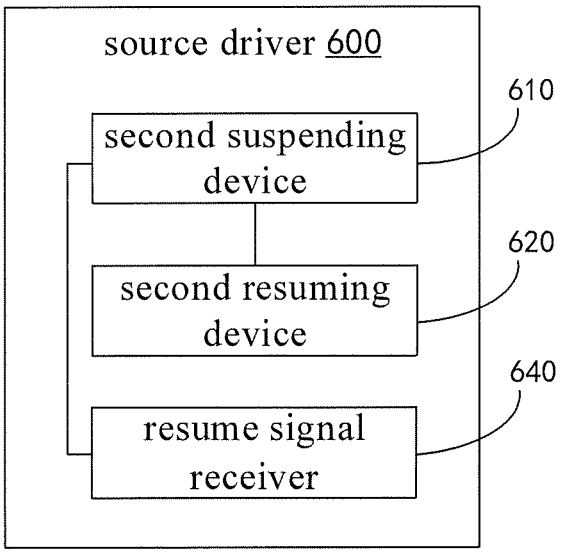
FIG. 6*c* is a block diagram of another source driver according to an embodiment of the present disclosure.

Optionally, as shown in FIG. 6*c*, the source driver 600 may further include:

a resume signal receiver 640 configured to receive a resume transmission signal transmitted by the timing controller before a receiving time of the second data packet. The second resuming device resumes the transmission of valid data between the source driver and the timing controller according to the resume transmission signal.

Optionally, the resume transmission signal includes clock patterns and link stable patterns in accordance with an order of transmission, the clock patterns are configured to synchronize clock signals of the source driver and the timing controller, and the link stable patterns are configured to wait for the source driver and the timing controller to resume transmission of valid data.

Optionally, a number of the clock patterns is greater than or equal to 48. A number of the link stable patterns is greater than or equal to 5, and the duration of the link stable patterns is at least 1 microsecond.

Optionally, the first data packet includes a control packet, and the control packet includes a power saving control bit. The power saving control bit may be set to indicate low power control signaling or not to indicate low power control signaling.

As an example, the second suspending device 610 may be configured to: determine whether the power saving control bit indicates the low power control signaling; when the power saving control bit indicates the low power control signaling, suspend the transmission of valid data between the source driver and the timing controller after reception of the first data packet is completed.

In summary, in the source driver provided by the embodiments of the present disclosure, the transmission of the first data packet is completed in advance by increasing the transmission speed, then the data transmission is suspended, and the data transmission is resumed at the transmitting time of the second data packet. Thus, the problem that power consumption for data transmission between the timing controller and the source driver is large in related art is solved. The timing controller and the source driver can suspend data transmission to reduce power consumption.

Figure 7:
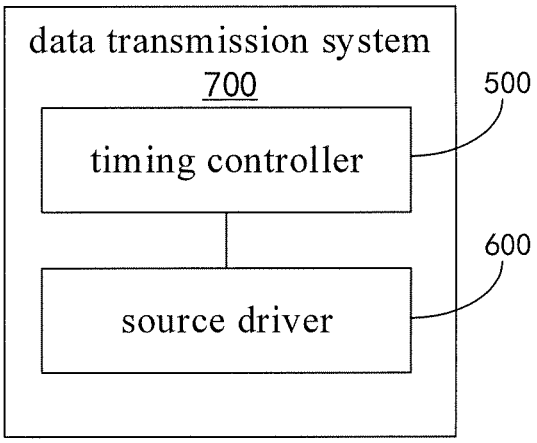
FIG. 7 is a block diagram of a data transmission system according to an embodiment of the present disclosure.

FIG. 7 shows a block diagram of a data transmission system 700 according to an embodiment of the present disclosure, which may be applied to a display panel. The data transmission system 700 includes a timing controller 500 and a source driver 600, wherein the timing controller 500 is any of the timing controllers as described above with reference to FIG. 5*a* to FIG. 5*d*, and the source driver 600 is any of the source drivers as described above with reference to FIG. 6*a* to FIG. 6*c*.

Embodiments of the present disclosure further provide a computer readable non-transitory storage medium having stored thereon instructions that, when executed on a computer, cause the computer to execute the data transmission method performed by a timing controller or a source driver in the embodiment shown in FIG. 4*a*.

It should be understood that the devices and methods disclosed in the embodiments provided by the present disclosure may be implemented in other manners. For example, the devices described above are merely illustrative. For example, the division of the units is only a logical function division, and the actual implementation may have another division manner. For example, multiple units or components may be combined or integrated into another system, or some features may be omitted or not implemented. Furthermore, the mutual coupling or direct coupling or communication connection shown or discussed may be through some interfaces, and the indirect coupling or communication connection of the devices or units may be in an electrical, mechanical or other form.

The units described as separate components may or may not be physically separate. The components displayed as units may or may not be physical units, that is, may be located in one place, or may be distributed to multiple network units. Some or all of the units may be selected according to actual needs to achieve the purpose of the solution of the embodiments.

Those skilled in the art can understand that all or part of the steps of implementing the above embodiments may be completed by hardware, or may be completed by instructing related hardware by a program, and the program may be stored in a computer readable non-transitory storage medium. The non-transitory storage medium may be a read only memory, a magnetic disk, an optical disk or the like.

The above description is only optional embodiments of the present disclosure and is not intended to limit the disclosure. Any modifications, equivalent substitutions, improvements, etc., made within the spirit and scope of the present disclosure are intended to be included within the scope of the present disclosure.

The invention claimed is:

1. A data transmission method applied to a timing controller, the timing controller transmitting data to a source driver at a speed n times a preset speed, the preset speed being determined according to a size and a refresh rate of a display panel, n being greater than or equal to 1, and the method comprising:

suspending transmission of valid data to the source driver after completing transmission of a first data packet; and resuming the transmission of the valid data to the source driver at a transmitting time of a second data packet, wherein the second data packet is a next data packet transmitted after the first data packet, and the first data packet and the second data packet each comprises valid row data of a respective row of sub-pixels, or each comprises valid frame data for a frame.

2. The data transmission method of claim 1, further comprising:

transmitting, in a process of transmitting the first data packet, low power control signaling to the source driver, the low power control signaling being configured to notify the source driver to suspend the transmission of the valid data between the source driver and the timing controller after reception of the first data packet is completed.

3. The data transmission method of claim 2, wherein before the suspending the transmission of the valid data to the source driver, the method further comprises:

transmitting invalid data to the source driver after the completing the transmission of the first data packet, to wait for the source driver to suspend receiving the valid data transmitted by the timing controller.

4. The data transmission method of claim 3, wherein the invalid data comprises 64 invalid data packets, and each of the 64 invalid data packets comprises 10 bits.

5. The data transmission method of claim 2, wherein the first data packet comprises a control packet, the control packet comprises a power saving control bit, and the transmitting the low power control signaling to the source driver comprises:

setting the power saving control bit to indicate the low power control signaling; and transmitting the first data packet comprising the control packet to the source driver.

6. The data transmission method of claim 1, wherein the suspending the transmission of the valid data to the source driver comprises:

maintaining a communication link for transmitting data to the source driver and suspending the transmission of the valid data to the source driver.

7. The data transmission method of claim 1, wherein the suspending the transmission of the valid data to the source driver comprises:

disconnecting a communication link for transmitting data to the source driver.

8. The data transmission method of claim 1, further comprising:

transmitting a resume transmission signal to the source driver before the transmitting time of the second data packet, the resume transmission signal being configured to notify the source driver to resume the transmission of the valid data with the timing controller.

9. The data transmission method of claim 8, wherein the resume transmission signal comprises clock patterns and link stable patterns in accordance with an order of transmission, and wherein the clock patterns are configured to synchronize clock signals of the source driver and the timing controller, and the link stable patterns are configured to wait for the source driver and the timing controller to resume the transmission of the valid data.

10. The data transmission method of claim 9, wherein a number of the clock patterns is greater than or equal to 48, a number of the link stable patterns is greater than or equal to 5, and a duration of the link stable patterns is at least 1 microsecond.

11. A computer readable non-transitory storage medium storing instructions that, when executed on a computer, cause the computer to perform the data transmission method of claim 1.

* * * * *